US007757852B2

(12) United States Patent
Fontana

(10) Patent No.: US 7,757,852 B2
(45) Date of Patent: Jul. 20, 2010

(54) PACKAGE FOR PHARMACEUTICAL, MEDICAL OR SIMILAR PRODUCTS, PARTICULARLY PESTICIDES OR PLANT PROTECTION PRODUCTS

(75) Inventor: Antonio Fontana, Carpi (IT)

(73) Assignee: Bayer Cropscience AG, Monheim (DE)

( * ) Notice: Subject to any disclaimer, the term of this patent is extended or adjusted under 35 U.S.C. 154(b) by 186 days.

(21) Appl. No.: 11/794,307

(22) PCT Filed: Dec. 28, 2005

(86) PCT No.: PCT/EP2005/057194

§ 371 (c)(1),
(2), (4) Date: Jul. 30, 2007

(87) PCT Pub. No.: WO2006/070003

PCT Pub. Date: Jul. 6, 2006

(65) Prior Publication Data

US 2008/0210589 A1 Sep. 4, 2008

(30) Foreign Application Priority Data

Dec. 30, 2004 (FR) ..... MO2004A0351

(51) Int. Cl.

| | |
|---|---|
| ***B65D 73/00*** | (2006.01) |
| ***B65D 85/00*** | (2006.01) |
| ***B65D 35/56*** | (2006.01) |
| ***B65D 47/10*** | (2006.01) |

(52) U.S. Cl. ..... 206/463; 206/232; 206/459.5; 206/528; 206/806; 222/105; 222/541.9

(58) Field of Classification Search ..... 206/232, 206/459.5, 461–471, 484, 528–530, 806; 222/541.1–541.9, 106, 107, 129
See application file for complete search history.

(56) References Cited

U.S. PATENT DOCUMENTS

| | | | | | |
|---|---|---|---|---|---|
| 2,808,926 | A | * | 10/1957 | Drake et al. | 206/530 |
| 2,965,222 | A | * | 12/1960 | Kidwell | 206/534 |
| 3,333,684 | A | * | 8/1967 | Martelli | 206/461 |
| 3,352,409 | A | * | 11/1967 | Martin | 206/463 |
| 3,370,733 | A | | 2/1968 | Giesler | |
| 3,698,551 | A | | 10/1972 | Tomlinson | |
| 3,913,734 | A | * | 10/1975 | Siegel | 206/470 |
| 3,917,120 | A | * | 11/1975 | Larenz et al. | 222/129 |
| 4,209,096 | A | * | 6/1980 | Carkhuff | 206/469 |
| 4,496,051 | A | * | 1/1985 | Ortner | 206/459.5 |
| 4,512,475 | A | | 4/1985 | Federighi | |
| 4,998,621 | A | * | 3/1991 | Meehan | 206/466 |
| 5,826,737 | A | * | 10/1998 | Zakensberg | 222/541.6 |
| 6,860,405 | B1 | * | 3/2005 | Poynter | 222/541.6 |
| 7,241,066 | B1 | * | 7/2007 | Rosen et al. | 401/183 |

* cited by examiner

*Primary Examiner*—Bryon P Gehman
(74) *Attorney, Agent, or Firm*—Dykema Gossett PLLC

(57) ABSTRACT

A package (1) for pharmaceutical, medical or similar products, particularly pesticides or plant protection products, comprising a substantially flat element (2) for supporting indications (T) prescribed for a pharmaceutical, medical or similar product, particularly a pesticide or plant protection product, a first receptacle (3) for containing a container (4) of the product which is formed in the substantially flat element (2), and first means (5) for connecting the container (4) and the substantially flat element (2).

11 Claims, 2 Drawing Sheets

PACKAGE FOR PHARMACEUTICAL, MEDICAL OR SIMILAR PRODUCTS, PARTICULARLY PESTICIDES OR PLANT PROTECTION PRODUCTS

TECHNICAL FIELD

The present invention relates to a package for pharmaceutical products, medical products or the like, particularly pesticides or plant protection products.

BACKGROUND ART

In the agricultural field, it is known to use pesticides or plant protection products, i.e., products used essentially to protect plants against diseases (fungicides, insecticides, limacides, repellents and the like), to control the physiological functions of plants (plant growth regulators), to eliminate unwanted plants (herbicides), to eliminate parts of plants or restrain them or avoid their unwanted growth.

Usually, these products are marketed in sealed packages.

Known packages include those which comprise a container of the product, such as for example a bottle, a tube or the like, which is closed within an external protective enclosure such as for example a sachet, a case or the like, which can be removed at the time of use.

These packages are used particularly for containers of the single-dose type.

Further, known packages are provided with a label which bears the set of prescriptions for the individual product: name, type, formulation and composition of the product; crop, doses, methods, field and period of use; symbols of toxicity and danger; phytotoxicity; latency or safety periods; storage rules; safety rules; risk descriptions; precautionary recommendations; information for the physician in case of intoxication, irritation or poisonings and others.

Usually, the label is arranged on the outer enclosure, the one which is removed when the product is used, in order to extract the container from it, and is put to one side or even discarded; this occurs particularly in the case of single-dose containers, the limited external surface of which is insufficient to contain all the necessary prescribed indications.

These known packages are not free from drawbacks, including the fact that they do not allow operators assigned to using the pharmaceutical, medical or similar products, particularly pesticides or plant protection products, to have constantly available for immediate reference the indications prescribed for them.

Operators, after inspecting the label placed on the external enclosure, in fact open such enclosure in order to extract the container of the product from it, and put the enclosure to one side and/or discard it, handling only the container during the steps for use of the product.

Accordingly, the label is put to one side and/or discarded together with the external enclosure.

Since the information prescribed for the products being used are not always constantly at their disposal, operators may use the products inappropriately and excessively, with consequent possible environmental damage and imbalances, risks for their own physical safety and for the safety of others, such as for example risks of irritations, intoxications or poisonings, and risks of contaminations of the foods derived from plants treated incorrectly.

Another drawback of known packages, particularly packages which comprise single-dose containers, is that they do not allow easy and safe handling of the containers, the limited dimensions of which make it very difficult to squeeze them in order to dispense the products contained therein.

SUMMARY OF THE INVENTION

The aim of the present invention is to eliminate the above-mentioned drawbacks of known packages, by providing a package for pharmaceutical, medical or similar products, particularly pesticides or plant protection products, which allows operators assigned to the use of the products, particularly pesticides and plant protection products, to have constantly at their disposal for immediate reference the indications prescribed for the products, even in the case of single-dose packages.

Within this aim, an object of the present invention is to provide a package which allows to facilitate the correct use of these products and thus reduce the risks of environmental imbalances and damage, risks for the physical safety of the operators and of other individuals, and risks of contaminations of the foods derived from the treated plants.

Another object of the present invention is to provide a package which is easy to handle even if it is of the single-dose type.

A further object of the present invention is to provide a package which is simple, relatively easy to provide in practice, safe in use, effective in operation, and has a relatively low cost.

This aim and these and other objects that will become better apparent hereinafter are achieved by the present package for pharmaceutical, medical or similar products, particularly pesticides or plant protection products, characterized in that it comprises a substantially flat element for supporting indications prescribed for a pharmaceutical, medical or similar product, particularly a pesticide or plant protection product, a receptacle for containing a container of said product which is formed in said substantially flat element, and first means for connecting said container and said substantially flat element.

BRIEF DESCRIPTION OF THE DRAWINGS

Further characteristics and advantages of the present invention will become better apparent from the following detailed description of a preferred but not exclusive embodiment of a package for pharmaceutical, medical or similar products, particularly pesticides or plant protection products, illustrated by way of non-limiting example in the accompanying drawings, wherein.

DETAILED DESCRIPTION OF THE PREFERRED EMBODIMENTS

Figure 1:
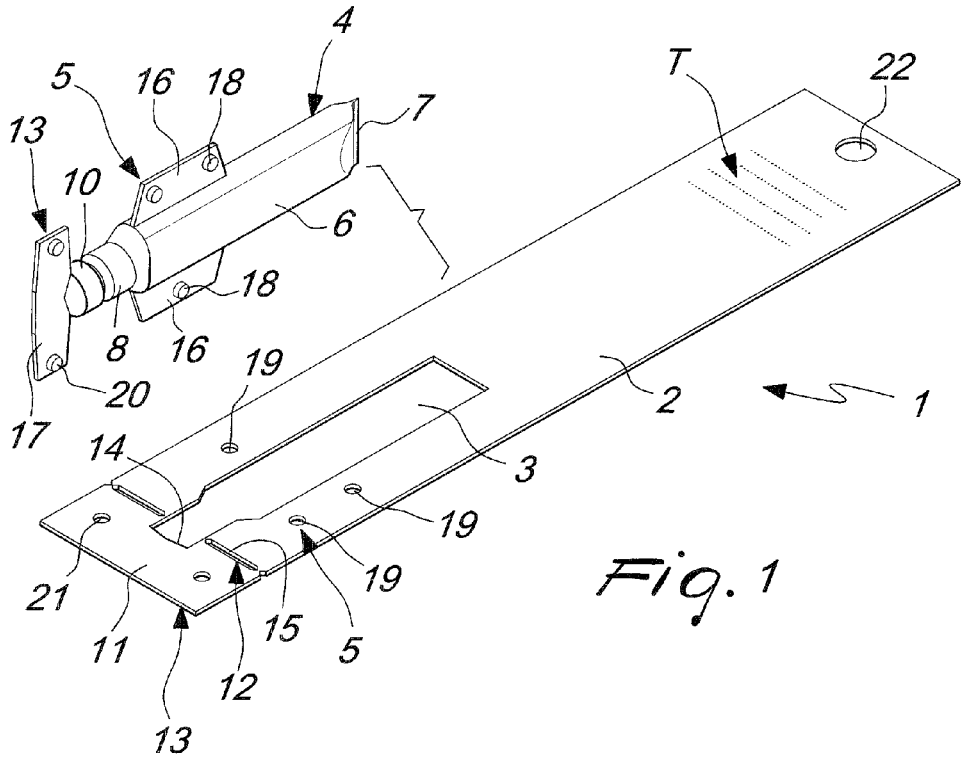
FIG. 1 is a schematic exploded view of a package according to the invention.

With reference to the figures, the reference numeral 1 generally designates a package for pharmaceutical, medical or similar products, particularly pesticides or plant protection products.

The package 1 comprises a substantially flat element, which is constituted for example by a panel 2 suitable to support a set of prescriptions for a product, schematically designated by the outlines T, and in which there is a first receptacle 3 for accommodating a container 4 of the product, first means 5 for connecting the container 4 and the panel 2 being provided.

The container 4 can be in particular of the single-dose type and can be shaped like a bottle, tube or the like.

The container 4 can comprise for example a body 6, which is closed on the bottom 7 and continues with a neck 8, at the top end of which a product dispensing outlet 9 is formed.

A removable closure element 10, such as for example a stopper, a cap or the like, is associated with the dispensing outlet 9 and can be rigidly coupled to the dispensing outlet 9 along a weakened and breakable band.

The package 1 further comprises a tab 11, which is associated with the panel 2 and is substantially coplanar thereto by way of coupling means 12 of the temporary and removable type.

The tab 11 supports the closure element 10, and second means 13 for connecting the closure element 10 and the tab 11 are provided. A second receptacle 14 for accommodating the closure element 10 is formed in the tab 11.

The panel 2 is shaped for example like an elongated rectangle, at one end of which the first receptacle 3 is formed, and continues, at the opposite end, with a tab, on one or both faces of which all the prescriptions for the product contained in the container 4 are provided, such tab also acting as a grip element for the operator.

The tab 11 is constituted for example by a portion of the panel 2, which is formed at the end thereof where the first receptacle 3 is provided, while the coupling means 12 are constituted for example by a weakened region 15, which delimits said portion and allows to remove the tab 11 by tearing and therefore remove the closure element 10 rigidly coupled thereto.

The first receptacle 3 is constituted by an opening, the perimeter of which substantially and at least partially reproduces the profile of the container 4, particularly of the body 6 and of the neck 8.

Likewise, the second receptacle 14 is constituted by an opening, the perimeter of which substantially and at least partially reproduces the profile of the closure element 10.

Corresponding wings 16 and 17 are formed at the sides of the container 4 and at the top end of the closure element 10, and the first connecting means 5 and the second connecting means 13 are provided respectively therein, such wings being suitable to be superimposed respectively on the panel 2 and on the tab 11.

The first connecting means 5 and the second connecting means 13 are of the permanent type.

The first connecting means 5 can comprise for example first pins 18, which protrude from the wings 16 of the container 4 and can be inserted with interference in corresponding first holes 19 formed in the panel 2 laterally with respect to the first receptacle 3.

The second connecting means 13 comprise second pins 20, which protrude from the wing 17 and can be inserted with interference in corresponding second holes 21 formed in the tab 11 at the sides of the second receptacle 14.

Conveniently, the coupling between the first pins 18 and the first holes 19 and between the second pins 20 and the second holes 21 is conical; further, the first pins 18 and the second pins 20 are additionally fixed by hot riveting.

However, alternative embodiments of the first connecting means 5 and of the second connecting means 13 are not excluded and, for example, might comprise rivets or welds, obtained for example by means of ultrasound or by thermal bonding, adhesive bonding or the like formed respectively between the body 4 and the panel 2 and between the closure element 10 and the tab 11.

Conveniently, the panel 2 and/or the tab 11 are made of a substantially rigid material such as for example card or cardboard, cardboard bonded with plastic material, polymeric material (for example polypropylene), or the like; they are formed monolithically, for example by scoring and cutting by means of die-cutters.

Finally, the package 1 comprises means for engagement with a supporting element, such as for example a slot 22 for the insertion of a hook 23.

Figure 2:
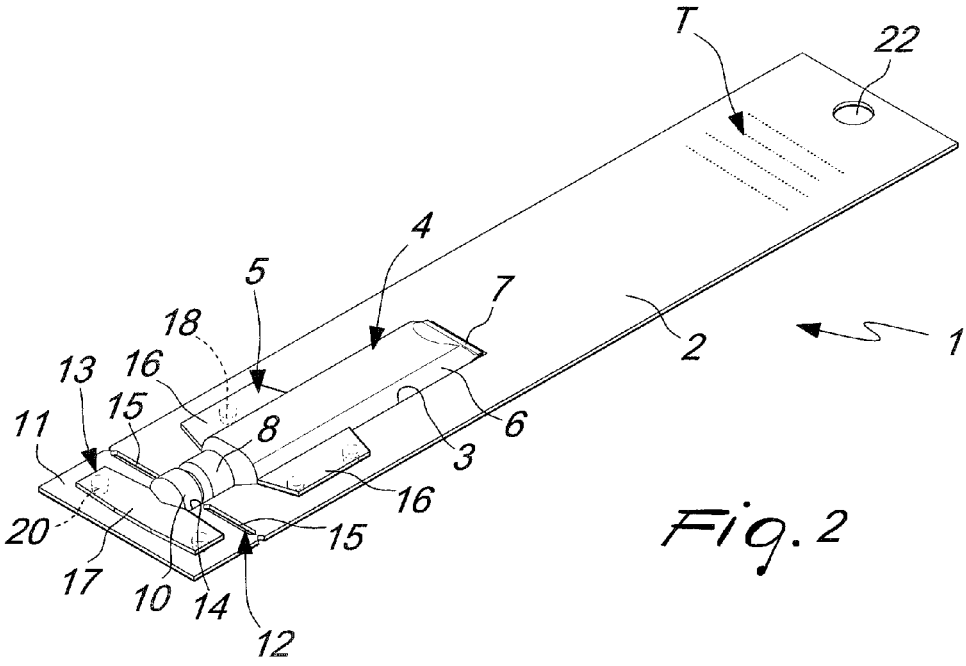
FIG. 2 is a schematic perspective view of a package according to the invention in the closure configuration.
Figure 4:
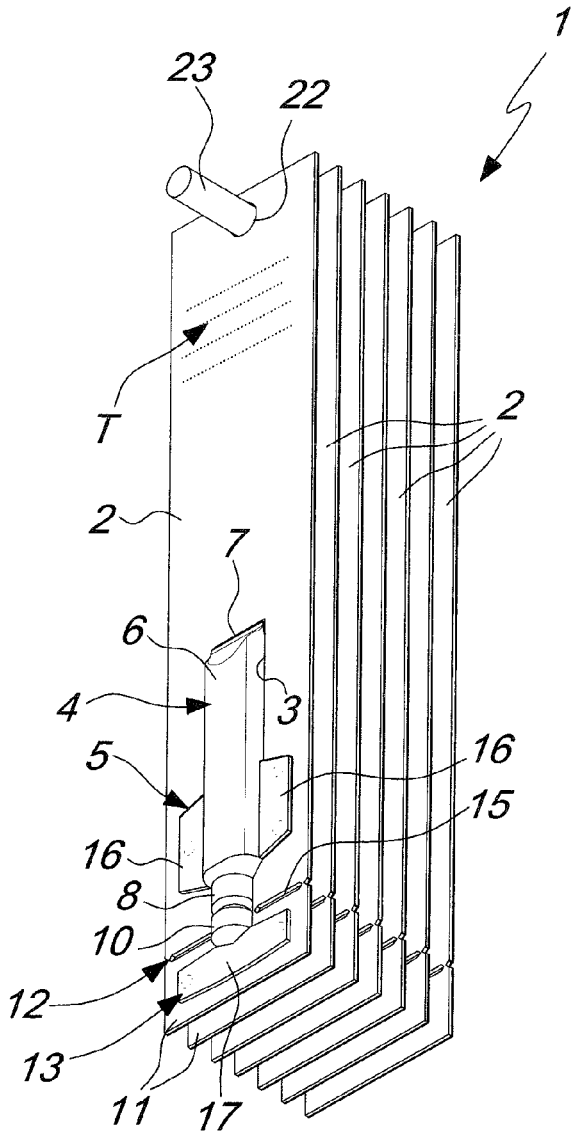
FIG. 4 is a schematic perspective view of plurality of packages according to the invention, stored in the closure configuration.

The operation of the invention is as follows: the package 1 in the closed configuration (FIGS. 2 and 4) has a tab 11 which is monolithically coupled to the panel 2; the body 4 and the closure element 10 are mutually rigidly associated temporarily and are respectively accommodated within the first receptacle 3 and the second receptacle 14 and are permanently coupled respectively to the panel 2 and the tab 11 by virtue of the first connecting means 5 and the second connecting means 13.

In this configuration, the package 1 can be stored easily, for example by hanging it on the supporting hook 23.

Figure 3:
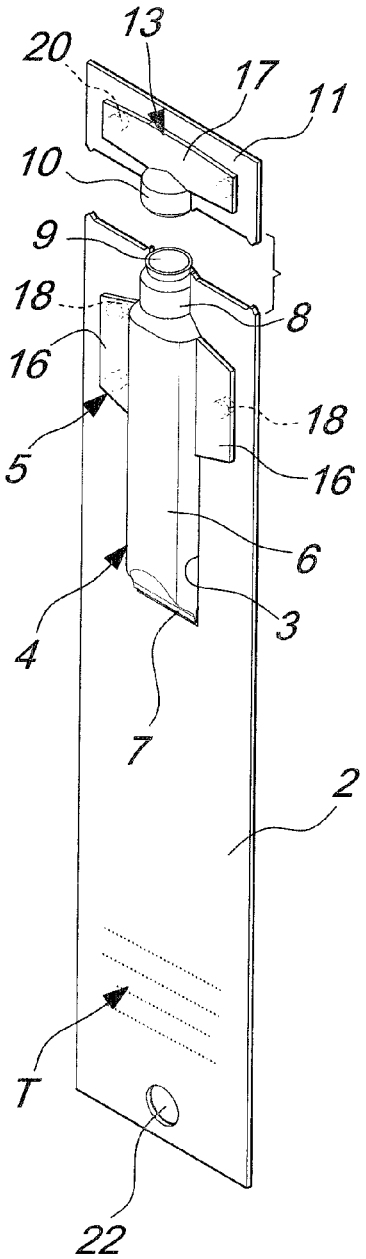
FIG. 3 is a schematic perspective view of a package according to the invention in the open configuration.

At the time of use, it is sufficient to apply to the tab 11 a twisting/tearing action such as to tear the weakened region 15 in order to disengage the tab 11 from the panel 2 and therefore remove the closure element 10 rigidly coupled thereto from the container 4, opening its dispensing outlet 9 (FIG. 3).

The indications (outlines T) provided on the panel 2 are therefore constantly available for reference on the part of the operator who is handling the container 4 throughout the steps of the use of the product contained therein, since the container 4 is coupled permanently to the panel 2.

Moreover, the elongated configuration of the panel 2 facilitates the grip, handling and squeezing of the container 4 in order to dispense the product contained therein, particularly if it is small, such as for example in the case of single-dose containers.

In practice it has been found that the described invention achieves the proposed aim and objects.

The invention thus conceived is susceptible of numerous modifications and variations, all of which are within the scope of the appended claims.

All the details may further be replaced with other technically equivalent ones.

In practice, the materials used, as well as the shapes and the dimensions, may be any according to requirements without thereby abandoning the scope of the protection of the appended claims.

The invention claimed is:

1. A package which comprises:

a container for a fluid product, said container includes an outlet, a removable closure element for said outlet, and a first wing, and a discrete substantially flat support element which is generally rectangular and has opposite respective first and second ends, said support element defining a main portion and a removable tab portion at said first end, said main portion defining a first receptacle near said tab portion capable of receiving said container; and said main portion displaying indications for use of a fluid product located near said second end, and a first connection means for connecting said container to said element, said first wing of said container having means for connection to said tab portion of said element when said container is positioned in said receptacle.

2. The package according to claim 1, including a second connection means connecting said first wing to said tab portion.

3. The package according to claim 2, wherein said second connection means comprises at least one pin.

4. The package according to claim 2, wherein said tab portion is connected to said main portion by a coupling means.

5. The package according to claim 4, wherein said main portion and said tab portion are parts of a single panel, and wherein said coupling means comprises a weakening indentation in said panel.

6. The package according to claim 1, wherein said container is elongated and includes a neck which provides said outlet.

7. The package according to claim 6, wherein said tab portion defines a second receptacle which is connected to said first receptacle, said neck of said container being positioned in said second receptacle.

8. The package according to claim 7, wherein said first and second receptacles comprise respective openings in said support element.

9. The package according to claim 1, wherein said first connection means comprises a second wing on said container and at least one pin which connects said second wing to said support element.

10. The package according to claim 1, wherein said support element includes engagement means for attachment to an external member.

11. The package according to claim 10, wherein said engagement means comprises a slotted opening in said main portion.

* * * * *